US005597158A

United States Patent [19]

Spikes

[11] Patent Number: 5,597,158

[45] Date of Patent: Jan. 28, 1997

[54] BASKETBALL GOAL

[76] Inventor: Preston Spikes, 800 Allen St., Oakdale, La. 71463

[21] Appl. No.: 574,656

[22] Filed: Dec. 19, 1995

[51] Int. Cl.[6] ..... A63B 63/08

[52] U.S. Cl. ..... 473/485; D21/201

[58] Field of Search ..... 273/1.5 R; D21/201

[56] References Cited

U.S. PATENT DOCUMENTS

| | | | |
|---|---|---|---|
| D. 101,090 | 9/1936 | Sandberg . | |
| D. 238,284 | 12/1975 | Toedter . | |
| 1,193,024 | 8/1916 | Kennedy . | |
| 1,218,204 | 3/1917 | Ohlson . | |
| 1,308,831 | 7/1919 | Albach . | |
| 1,583,011 | 5/1926 | Roe . | |
| 3,603,588 | 9/1971 | Ebstein . | |
| 3,788,642 | 1/1974 | Matras et al. . | |
| 4,082,269 | 4/1978 | Hill | 273/1.5 R |
| 4,650,188 | 3/1987 | Schroeder | 273/1.5 R |
| 4,846,469 | 7/1989 | Nye | 273/1.5 R |
| 5,255,910 | 10/1993 | Simonseth . | |

FOREIGN PATENT DOCUMENTS

| | | | |
|---|---|---|---|
| 1313021 | 11/1962 | France . | |
| 2596996 | 10/1987 | France . | |
| 2694506 | 2/1994 | France . | |
| 7905257 | 1/1981 | Netherlands | 273/1.5 R |
| WO94/16779 | 8/1994 | WIPO . | |

OTHER PUBLICATIONS

KBA Basketball Coaching and Training Aids 1989 School Mail Order Catalog, p. 33 Heavy Duty Bent Post Basketball Backstop.

Miracle Recreation Equipment Company, Catalog 773, p. 55, Model 740.

Porter, Celebrating 100 Years of Basketball Catalog, Huffy Sports Graphite SLAM JAM.

Sportime, 1993, Summer Edition Catalog, p. 133, Super Goals.

*Primary Examiner*—Paul E. Shapiro

*Attorney, Agent, or Firm*—Richard C. Litman

[57] ABSTRACT

An improved basketball goal assembly that combines buttressed side support arms, an L-brace, and at least one center plate brace to provide greater structural integrity to the goal. A horizontal section of the L-brace is attached at one end to the hoop, and a vertical section extends from the opposite end. Each side support is attached to the hoop on one end and to the vertical section of the L-brace on the other end. Each arm may have a bend proximate its attachment end to the hoop, allowing the arms to avoid obstruction of the aperture defined by the hoop. The basketball goal is mounted to a backboard along a back side of the vertical section of the L-brace. Each part of the goal provides enhanced support to the others for overall synergistic integrity. Deformation and failure of the goal as a whole is drastically reduced under conditions of strenuous use.

8 Claims, 4 Drawing Sheets

BASKETBALL GOAL

BACKGROUND OF THE INVENTION

1. Field of the Invention

The present invention relates to basketball goal assemblies. More particularly, the invention is an improvement in goal support structures.

2. Description of the Prior Art

The game of basketball is one of the major sports in the United States. It is played at professional and amateur levels both in organized leagues and as a recreational activity. Variations such as half court, one-on-one, free throw contests, and dunking contests are also enjoyed at all levels. The constant in all basketball games and contests is the game ball, from which basketball derives its name, and at least one goal. Each goal typically includes a hoop, a net suspended from the hoop, and a hoop support for attachment to a vertically planar surface. The hoop is positioned in a horizontal plane. The support spaces the hoop from the vertically planar surface. The vertically planar surface may be provided as part of an independent structure such as a backboard on a post, or may be a wall of a building.

Due to the popularity of basketball, goal structures must withstand a great amount of use and abuse once installed. Some practitioners routinely "slam dunk" baskets, placing direct pressure on the hoop's ring structure. Worse still, others hang their entire weight from the hoop. Further, outdoor installations must also weather environmental stresses. Under these strenuous conditions, prior art goals become disfigured or break, thereby depriving everyone of their use.

The concept of providing support in the form of bracing arms disposed on either side of a hoop has been explored in the prior art. For example, U.S. Pat. No. 1,308,831, issued Jul. 8, 1919 to Frank Albach describes a basketball goal with a horizontal support arm integral with the hoop and a pair of angularly disposed brace members. French Patent No. 2,596,996, published Oct. 16, 1987 and assigned to Etablissements Villeroy describes a multi-part hoop support that includes a horizontal portion integral with the hoop, a pair of brackets, and a pair of extensible support arms. The horizontal portion is pivotally mounted over the brackets through a pin, and each arm secures to one side of the hoop. U.S. Pat. No. 1,218,204, issued Mar. 6, 1917 to Henry C. Ohlson describes a portable goal of knockdown construction that includes a ring, a bracket member, and screw type fasteners. The pictured goal includes three support arms, a short horizontal arm and two longer diagonal arms.

U.S. Pat. No. 3,603,588, issued Sep. 7, 1971 to John W. Ebstein et al. describes a basketball goal with brace rods to the hoop at circumferentially spaced points to form a unitary bail member that pivots upon a horizontal axis. A second pivotally mounted mail member disposed above the hoop engages the hoop to lock it in a horizontal position. U.S. Pat. No. 3,788,642, issued Jan. 29, 1974 to Earl L. Matras et al. describes a similar device.

Other bracing members including plate structures have also been used. For example, U.S. Pat. No. 1,583,011, issued May 4, 1926 to Everett W. Roe describes the use of webbed angle irons as auxiliary supports for a basketball goal. Design U.S. Pat. Nos. 101,090, issued Sep. 1, 1936 to Alvie E. Dandeberg; and 238,284, issued Dec. 30, 1975 to William C. Toedter show supports that include a pair of vertically aligned triangular bracing members that engage the sides of the hoop. PCT Application WO 94/16779, published Aug. 4, 1994, assigned to Gerard Van Ruymbeke, describes a spring biased deformable support structure for attaching a backboard to a vertical receiver surface. French Patent N. 2,694,506, published Feb. 11, 1994 and assigned to Etablissements Villeroy describes a telescoping support structure for basketball goals operated through pulleys. U.S. Pat. No. 5,255,910, issued Oct. 26, 1993 to John Simonseth describes a hoop support having a spring biased joint to provide a movable basketball goal assembly.

U.S. Pat. No. 1,193,024, issued Aug. 1, 1916 to Joseph P. Kennedy describes basketball goal having a hoop formed from a ring of varying circular cross-section. The ring is thickest at the back of the hoop where it is attached to a hoop support.

French Patent No. 1,313,021, published Nov. 12, 1962 and assigned to M. Robert Sion describes various removable and/or collapsible hoop support structures for basketball goals.

None of the above inventions and patents, taken either singly or in combination, is seen to describe the instant invention as claimed.

SUMMARY OF THE INVENTION

The present invention provides for an improved basketball goal assembly that combines buttressed side support arms and at least one vertically disposed center plate brace to provide greater structural integrity to the goal as a whole than previously available in the prior art. Each side support arm includes a bend proximate its attachment end to the hoop, allowing the arms to avoid obstruction of the aperture defined by the hoop.

The goal assembly further has a L-brace which includes a horizontal section and a vertical section. The vertical section of the L-brace is rigidly attached to one end of both the side arms, and to one edge of the plate brace. This vertical sectional mounted to a backboard on the side opposite its attachment to the support arms and plate brace.

Each of the support element of the present invention enhances the others to provide synergistic structural integrity. For example, the plate brace reduces vertical deformation of the L-brace; the side arms reduce side-to-side displacement of the hoop as well as distribute stresses from the brace elements; and the buttresses reduce deformation of the side arms.

For the purposes of the present invention, "backboard" is used in reference to the surface upon which the hoop support is attached, but is intended to encompass any such vertically planar surface including backboards, a wall, or the like. Any conventional fastening mechanism may be used to attach the present goal to the backboard, including bolts, screws, or rivets. Additionally, biasing members, such as springs of the coil or resilient bent plate type may be provided to allow some flexibility in this attachment.

Accordingly, it is a principal object of the invention to provide a basketball goal structure capable of withstanding strenuous conditions of use.

It is another object of the invention to provide an integrated hoop and hoop support structure particularly suited for installation.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
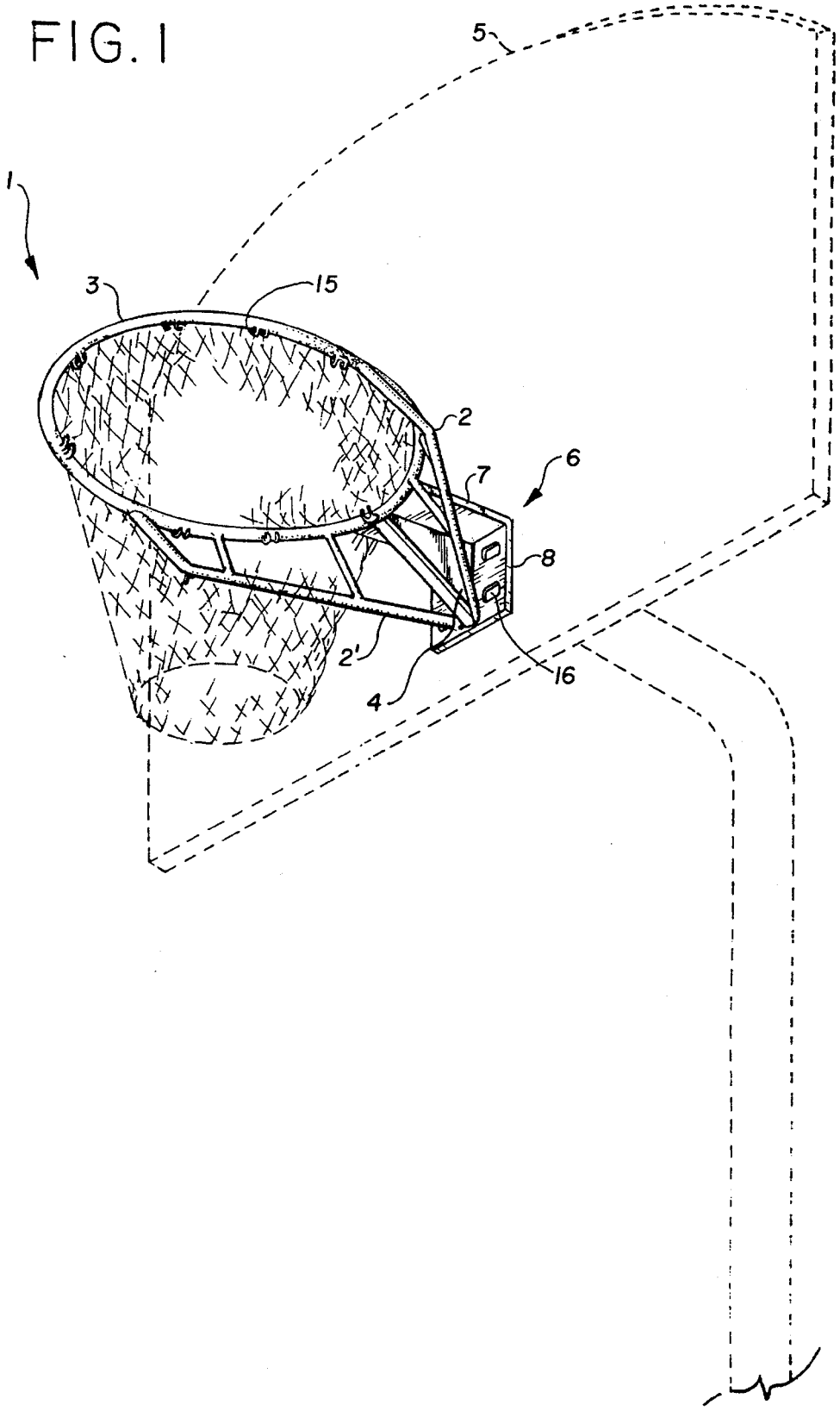
FIG. 1 is an environmental perspective view of the present invention mounted to a backboard

As shown in the figures, the present invention is an improved basketball goal assembly 1 that includes side support arms 2 and 2', hoop 3, at least one vertically disposed center plate brace 4, and a L-brace 6. A plurality of net hooks 15 are disposed on the underside of hoop 3 to support a net.

Figure 5:
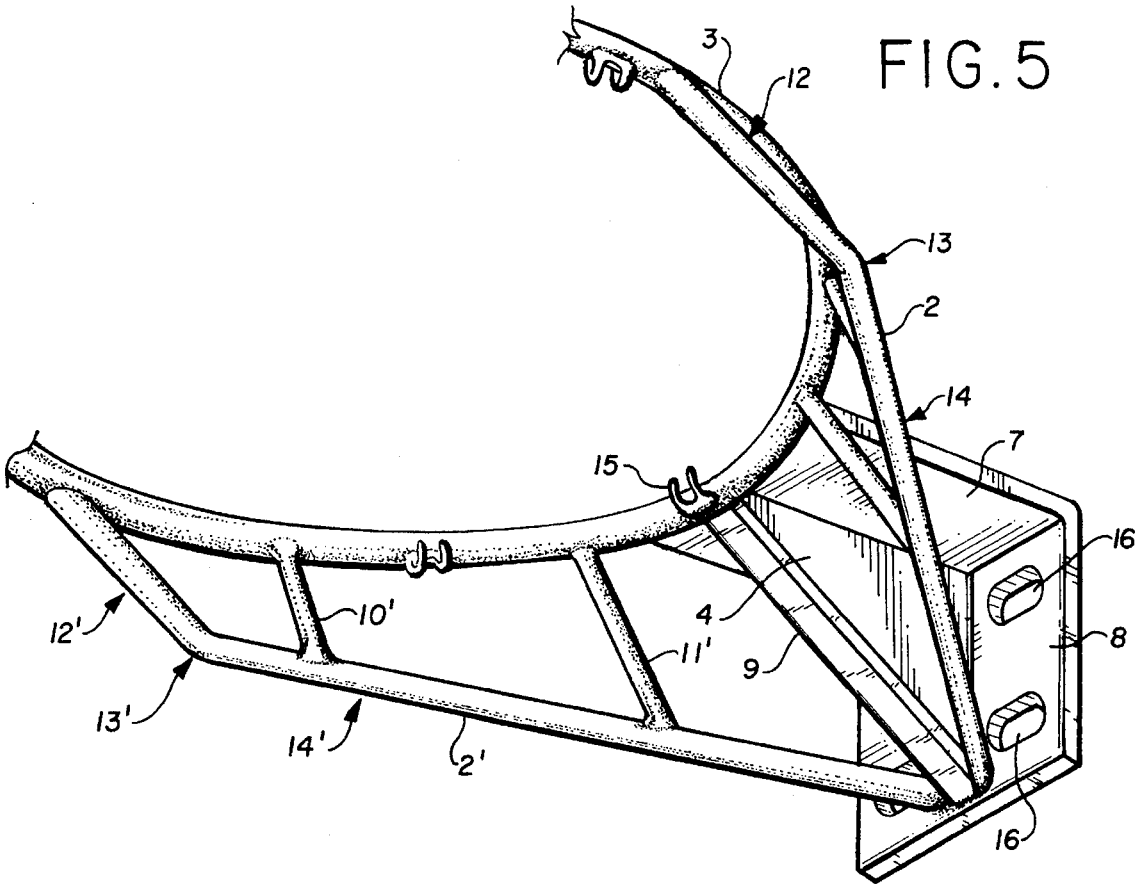
FIG. 5 is an expanded partial perspective view thereof.

The L-brace 6 includes a horizontal section 7 and a vertical section 8. The back side of vertical section 8 is mounted to a backboard 5. A plurality of holes 16 may be provided in said vertical section for backboard fasteners. The horizontal section 7 integrally connects to vertical section 8 at one end, and is fixedly attached to hoop 3 on the other. Plate brace 4 maintains the configuration of the L-shaped brace 6, and is preferably configured in triangular form to reduce obstruction of balls passing through the goal hoop 3. One edge of the plate brace 4 is attached to the underside of the horizontal section 7 of the L-shaped brace and another edge to the vertical section 8. As best shown in FIG. 5, the plate may have a guard 9 disposed on the remaining exposed edge to reduce injury. This guard may be optionally of resilient materials or padded.

Figure 2:
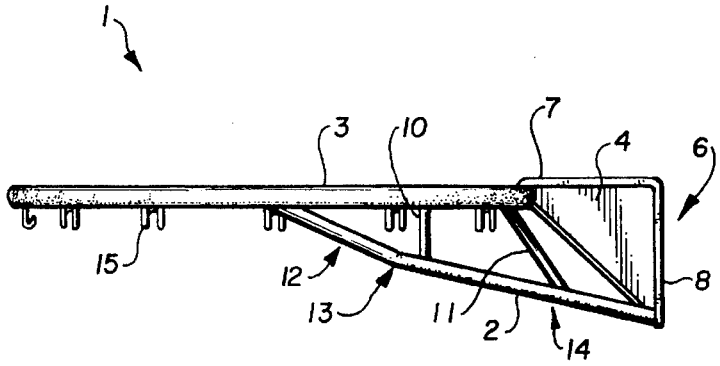
FIG. 2 is a side view thereof.
Figure 3:
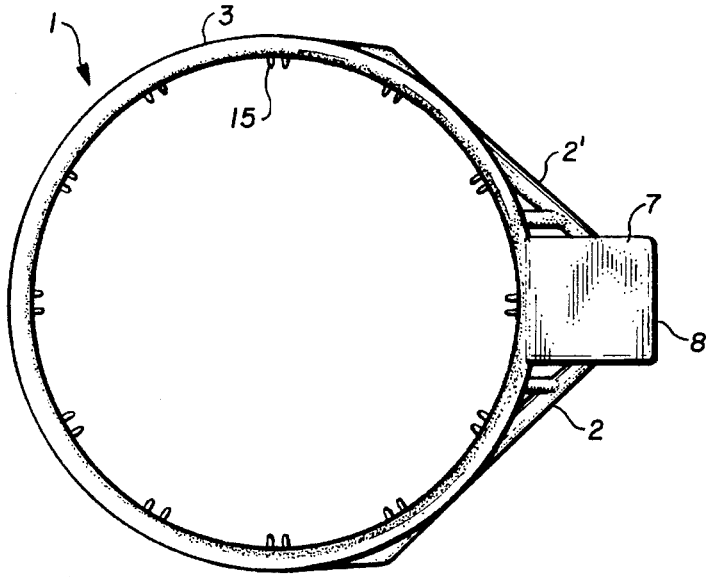
FIG. 3 is a top view thereof.
Figure 4:
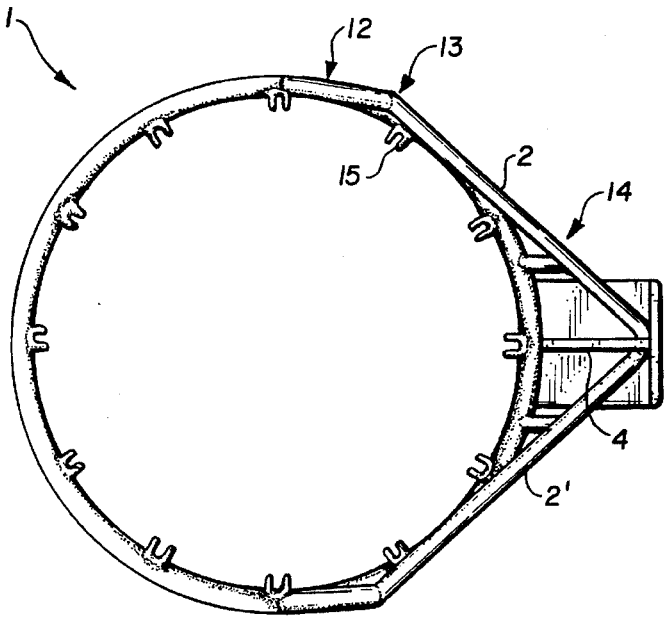
FIG. 4 is a bottom view thereof.

The arms 2 and 2' are each attached at one end to the hoop and at the other end to L-brace 6. Side support arms 2 and 2' include first sections 12 and 12', bends 13 and 13', and second sections 14 and 14'. Preferably, the first sections 12 and 12' are substantially parallel to each other and tangentially attached to hoop 3, while second sections 14 and 14' converge towards each other. Accordingly bends 13 and 13' give the angle defined between the first sections and second sections a horizontal component, as best seen in FIGS. 3 and 4. Further, the bends preferably give the angle between sections a vertical component, as seen in FIG. 2. This allows the attachment between hoop 3 and the first sections 12 and 12' to transfer vertical stresses with less sheering force by increasing the angle towards 90°. The arms are preferably positioned to avoid hindering the passage of a ball through the goal from contacting therewith. Accordingly, they may be spread apart further from each other than shown in the figures, particularly FIGS. 3 and 4, but are preferably no closer to each other.

As shown in FIGS. 2 and 5, each side support arm preferably includes a plurality of buttresses 10, 11, 10', and 11' that rigidly secure arms 2 and 2' to the hoop 3 at a multiplicity of positions around the hoop. This provides further distribution of forces from the hoop to the support arms, which are then transferred to the L-brace. These buttresses are preferably disposed along the second section of each support arm.

The various parts of the present basketball goal may be assembled together and fixedly attached to each other, or any attached parts may be of substantially unitary construction. Any high tensile strength material may be used in the construction of the goal, including iron, steel, aluminum, or composites.

Figure 6:
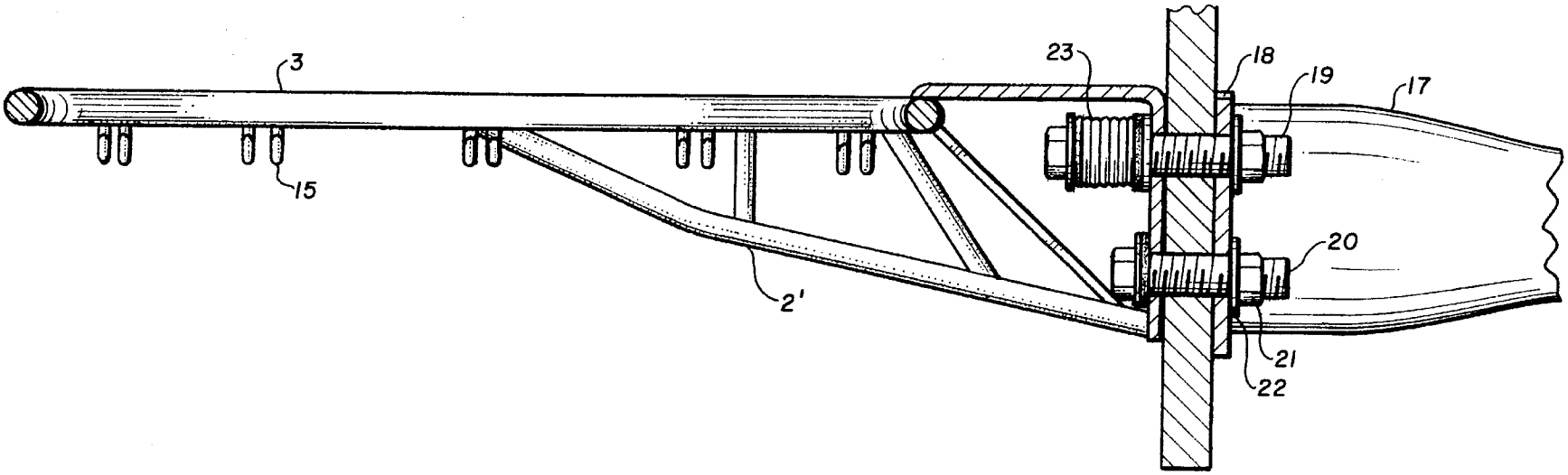
FIG. 6 is a side sectional view of thereof, showing a preferred securing mechanism.

As best seen in FIG. 6, the present basketball goal is preferably secured through backboard 5 to a backboard support structure 17. This support structure most preferably has a vertical plate section 18 having a plurality of apertures sized to receive bolts 19 and 20 and positioned to correspond to holes 16 of the L-brace 6. Bolts 19 and 20 serve to fix the present goal by sandwiching the backboard, and are secured through washers and nuts, such as 20 and 21. Most preferably, one or more springs 23 are mounted between washers along the bolt length to provide a degree of flexibility. This flexibility in the attachment of the present goal to a backboard/backboard support structure allows additional forces to be placed on the goal without deforming it. Further, the chance of injury to persons using the goal is decreased, as impact shock is partially absorbed by the spring structure.

It is to be understood that the present invention is not limited to the sole embodiment described above, but encompasses any and all embodiments within the scope of the following claims.

I claim:

1. A basketball goal comprising:

a hoop;

an L-brace having a horizontal section and a vertical section extending from one end of said horizontal section, said hoop rigidly attached to said horizontal section on an end opposite said vertical section;

at least one vertically disposed center plate brace attached on one edge to said vertical section of said L-brace and attached on another edge to said horizontal section of said L-brace;

a first side support arm attached on one end to said hoop at a point spaced from said L-brace and on the other end to said L-brace;

a second side support arm attached on one end to said hoop at a point spaced from said L-brace symmetrically opposite said first side support arm, and on the other end to said L-brace;

said first side support arm and said second side support arm each having a first section and a second section adjoined at an angle; and a plurality of buttresses, each of said buttresses being rigidly attached on one end to said hoop and on the other end to said second section of one of said first side support arm and said second side support;

wherein said basketball goal is mounted to a backboard through said vertical section of said L-brace.

2. The basketball goal according to claim 1, wherein said plate brace is triangular.

3. The basketball goal according to claim 2, wherein said plate brace further includes a guard on an exposed edge thereof.

4. The basketball goal according to claim 1, wherein said angle defined between said first section and said second section of said side support arm has a horizontal component.

5. The basketball goal according to claim 4, wherein said angle defined between said first section and said second section of said side support arm further has a vertical component.

6. The basketball goal according to claim 1, further comprising attachment means for securing said L-shape brace to said backboard.

7. The basketball goal according to claim 6, wherein said attachment means includes at least one nut and bolt assembly.

8. The basketball goal according to claim 7, wherein a spring is mounted along said nut and bolt assembly.

* * * * *